US010251468B1

(12) United States Patent
Moore et al.

(10) Patent No.: US 10,251,468 B1
(45) Date of Patent: Apr. 9, 2019

(54) INSULATED BEVERAGE CONTAINER

(71) Applicant: Grand Fusion Housewares, Inc., Irvine, CA (US)

(72) Inventors: Gary Christopher Moore, Salt Lake City, UT (US); Hilton Errol Blieden, Irvine, CA (US); Brendan Anthony Bauer, Frisco, TX (US)

(73) Assignee: Grand Fusion Housewares, Inc., Irvine, CA (US)

( * ) Notice: Subject to any disclaimer, the term of this patent is extended or adjusted under 35 U.S.C. 154(b) by 0 days.

(21) Appl. No.: 15/976,318

(22) Filed: May 10, 2018

(51) Int. Cl.

| | |
|---|---|
| ***A45F 3/18*** | (2006.01) |
| ***B65D 23/08*** | (2006.01) |
| ***B65D 81/38*** | (2006.01) |
| *B67B 7/44* | (2006.01) |
| *B65D 1/02* | (2006.01) |
| *B65D 41/04* | (2006.01) |
| *B65D 43/02* | (2006.01) |
| *A47G 19/22* | (2006.01) |

(52) U.S. Cl.
CPC ..... *A45F 3/18* (2013.01); *B65D 23/0885* (2013.01); *B65D 81/3881* (2013.01); *A47G 19/2205* (2013.01); *B65D 1/0246* (2013.01); *B65D 41/0414* (2013.01); *B65D 43/0225* (2013.01); *B67B 7/44* (2013.01)

(58) Field of Classification Search
CPC ... A45F 3/18; B65D 23/0885; B65D 81/3881; B65D 1/0246; B65D 41/0414; B65D 43/0225; A47D 19/2205; B67B 7/44
See application file for complete search history.

(56) References Cited

U.S. PATENT DOCUMENTS

| | | | | |
|---|---|---|---|---|
| 5,109,997 | A * | 5/1992 | Phillips | B65D 39/12 215/358 |
| 9,505,527 | B1 * | 11/2016 | Campbell | B65D 41/04 |
| 2008/0073314 | A1 * | 3/2008 | Condon | B65D 39/00 215/364 |
| 2008/0272086 | A1 * | 11/2008 | Granger | B65D 41/0492 215/354 |
| 2011/0204048 | A1 * | 8/2011 | Carino | A45F 3/18 220/4.03 |
| 2012/0074143 | A1 * | 3/2012 | Lin | A47J 31/18 220/259.4 |
| 2016/0244224 | A1 * | 8/2016 | Isogai | B65D 47/123 |
| 2017/0231272 | A1 * | 8/2017 | Pontano | A24F 29/00 206/101 |

* cited by examiner

*Primary Examiner* — Corey N Skurdal
(74) *Attorney, Agent, or Firm* — Louis C. Paul

(57) ABSTRACT

An insulated beverage protector for sealing and storing an open bottle comprised of: (i) a body having at least two sections, that removably attach to each other—(a) an upper section that is tapered and configured to snugly surround the tapered neck of the bottle and (b) a base section configured to snugly surround the cylindrical base of the bottle; (ii) a cover that removably attaches to the body; (iii) a stopper (stored within the cover) that removably attaches to the inside, top-most surface of the cover.

10 Claims, 4 Drawing Sheets

INSULATED BEVERAGE CONTAINER

FIELD OF INVENTION

An insulated beverage container that seals an open bottle.

BACKGROUND OF INVENTION

U.S. Pat. No. 9,505,527 ("the '527 Patent") issued on Nov. 29, 2016 from U.S. patent application Ser. No. 14/153,688 ("the '688 application"), and is directed to a protective bottle enclosure for enclosing and sealing the open mouth of a bottle (at the end/top of the bottleneck) inside the protective bottle enclosure. The protective bottle enclosure is comprised of a container and an external cover configured to removably engage the container. The cover has (i) a stopper and (ii) a cylindrical sleeve. The cylindrical sleeve partially extends inside of the neck of the upper portion of the container and surrounds a portion of the bottleneck. When the cover is fully seated (screwed/tightened) against the upper portion of the container, the cover forms a first seal (between the cover and the container). The cover is further configured to seal the open mouth of a bottle. More particularly, the stopper is described as being configured to form a second seal between the cover and the bottle, including when the bottle is in the "open" position, and the liquid contents of the bottle are accessible (through the open bottle mouth).

In certain embodiments, the container is comprised of (a) an upper portion and (b) a base. The upper portion has a (i) a neck, (ii) a shoulder below the neck and (iii) a lower section below the shoulder. The base has a (i) bottom and (ii) a sidewall configured to removably couple with the lower section. The neck of the upper portion is described as having internal threads that engage with external threads on the cover.

U.S. Pat. No. 9,637,270 ("the '270 Patent") issued on May 2, 2017 from U.S. patent application Ser. No. 15/362,540 ("the '540 application", which is a continuation of the '688 application). The '270 Patent, like the '527 Patent, claims aspects of the three sections of the protective bottle enclosure—the cover, cylindrical body, and base—in more detail. From top to bottom, the cylindrical body has (i) an upper opening at the end of a neck section, (ii) a neck section having interior threads, (iii) a middle section that is wider than the neck, and (iv) a bottom opening having exterior threads. The bottom opening of the cylindrical body is inserted into a base having (i) an open top, (ii) sidewalls with interior threads and (iii) a bottom. The interior threads of the base sidewall threadably engage the exterior threads of the bottom opening of the cylindrical body.

The cover has a cylindrical sleeve that is narrower than the neck section, and is configured to be inserted into the upper opening of the neck and to surround a portion of the bottleneck. The cylindrical sleeve has exterior threads that engage the interior threads of the neck section. When the base is fully engaged with the bottom opening of the cylindrical body, and the cover is fully engaged with the upper opening of the cylindrical body, the protective bottle enclosure seals and insulates the open bottle.

Both the '527 Patent and the '270 Patent teach that an elastomer may be wrapped within the upper portion of protective bottle enclosure. The elastomeric form is further described as being continuous, and generally cylindrical.

U.S. patent application Ser. No. 15/584,013 ("the '013 application") was filed on May 1, 2017, as a continuation of the '540 application. In response to a Non-Final Office Action filed on Jan. 17, 2018, the claims of the '013 application were amended to focus on a particular feature of a protective bottle enclosure not claimed in the '527 or '270 Patent—namely, a removable plastic cover comprising a plug connected to a cylindrical sleeve, the plug comprising an annular flange surrounding a stopper, the annular flange being configured to seal the open mouth of the bottle when the stopper is inserted into the open mouth of a bottle (inside of the protective bottle enclosure).

US Patent Application Publication 2011/0204048, now abandoned, teaches expandable and cleanable containers for storing materials for human consumption (i.e., beverages) comprised of: (a) a bottom piece with a threaded opening; (b) a first expansion piece with (i) a threaded bottom that is described as "complementary" and "threadedly connectable" to the threaded opening of the bottom piece, and (ii) a threaded bottom that is described as "complementary" and "threadedly connectable" to the threaded bottom of a bottom piece; and (c) a top piece threadably connectable to the first expansion piece. 2011/0204048 also teaches a second expansion piece which is threadedly connectable between (a) the first expansion piece and the bottom piece or (b) the first expansion piece and the top piece. The outer diameter of each of the sections are described as substantially similar.

The concept of expandable, cylindrical containers is further described in the following prior art patent publications.

U.S. Pat. No. 4,456,134 describes a container comprised of a top member having an opening for filling and pouring and a bottom member integrally connected with the bottom member by a flexible mid-section, comprised of three subsections, that is both expandable and compressible/collapsible. By expanding/collapsing the three subsections, the internal volume of the container may be incrementally adjusted.

U.S. Pat. No. 6,554,155 describes an insulating device for bottles having a lower cylindrical enclosure which "telescopically receives" an upper enclosure having a dome-shaped upper end. The upper and lower enclosures have mating threads adapted to achieve "a quick plunge insertion and sealing feature".

U.S. Pat. No. 6,814,252 teaches a rigid, cylindrical container with improved insulation for a necked beverage bottle comprised of (i) a base and (ii) a frustoconical top through which the neck of a beverage bottle may extend. The base is described as a rigid, generally cylindrical container having a bottom, an insulated sidewall, and open top. The sidewall and bottom form a generally cylindrical recess of a diameter that snugly receives the closed end of a beverage bottle. The top is formed of a flexible resilient insulating material, and releasably mounts/attaches to the base.

U.S. Pat. No. 7,614,516 likewise discloses an insulated beverage (bottle or can) holder having a lower cylindrical enclosure which receives an upper cylindrical enclosure. The lower cylindrical enclosure has vertical ribs to frictionally grip the upper cylindrical enclosure. The upper cylindrical enclosure is adapted to cover the top portion of a bottle inserted into the lower cylindrical enclosure and to snuggly receive a can or bottle when inverted and inserted into the lower cylindrical enclosure.

U.S. Patent Design Pat. No. D640935 S1 discloses the design of a container with a top cover that screws into a top section, a bottom cover that screws into a bottom section, and middle expansion ring that threadably connects (screws into) the top and bottom sections.

Multi-section metal (stainless steel or aluminum) beverage holders/coolers are marketed to cover/protect and insulate a necked beer bottle, with a top section tapered to fit the top section of the bottle (i.e., neck), and a bottom section configured to hold the cylindrical body of the bottle. By removing the top section, these same coolers can serve as an insulating sleeve for a beer can. Representative of these prior art protective beverage coolers is Asobu Frosty Beer 2 available on Amazon.com as Amazon Standard Identification Number (ASIN B079ZR13RJ) and ORCA Rocket Bottle Cup and Can Holder (ASIN B019NMPOC4); FitMaker Bottle Keeper (ASIN B077ZPXMN).

Some prior art insulated stainless steel beer bottle holders have a bottle opener integrated in the lid. See, e.g., Asobu Frosty Beer 2.

Other prior art stainless steel beer bottle holders have a bottle opener attached to the cover.

See, e.g., FitMaker Bottle Keeper.

SUMMARY OF THE INVENTION

An insulated beverage protector for sealing and storing an opened bottle comprised of (i) a body having at least two sections
  a. an upper section that is tapered and configured to snugly surround the tapered neck of the bottle, and
  b. a base section that is configured to snugly surround the cylindrical base of the bottle, and (ii) a cover having an inward-facing (inner) surface and an outward-facing (exterior) surface, wherein
  a. the inner surface is comprised of a downward-projecting post, and
  b. optionally, but preferably, the outer surface is comprised of a bottle cap opener, and (iii) a stopper having
  a. a top, preferably having a thumb screw,
  b. a tapered bottom, preferably threaded, and
  c. a hollow core/channel that mates with the downward-projecting post The insulated beverage protector may have one or several additional body section(s) between the upper section and bottom section.

DETAILED DESCRIPTION OF THE INVENTION

Figure 1A:
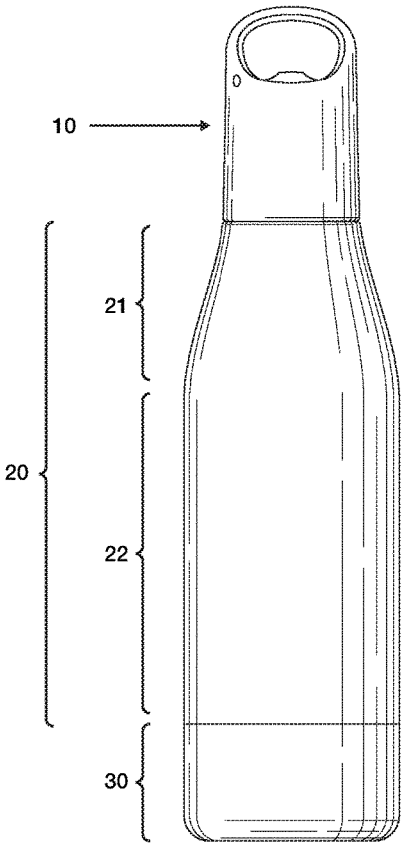
FIG. 1A shows one embodiment of the insulated beverage protector of the present invention in a closed position, with a cover [10] attached to a body [20], which is attached to a base [30]. The body has an upper section [21] and a base section [22]. The cover preferably has a handle [50].
Figure 1B:
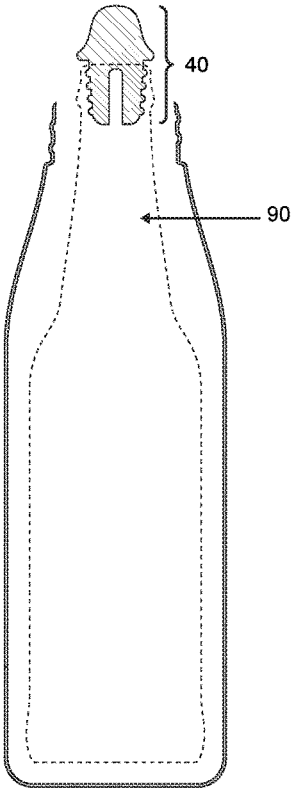
FIG. 1B shows a cut-away view of one embodiment of the insulated beverage protector of the present invention in an open position, with the cover removed and an opened bottle [90] with a stopper [40] inserted into the bottle mouth.
Figure 2A:
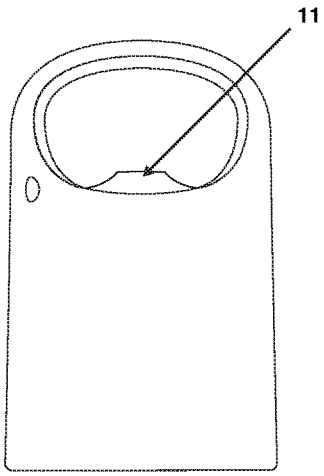
FIG. 2A is a front view of the cover with an integrated bottle opener [11].
Figure 2B:
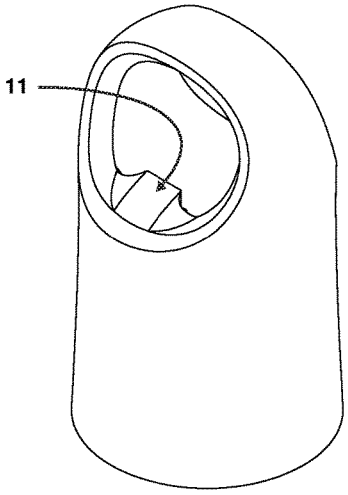
FIG. 2B is a front-perspective view of the cover with an integrated bottle opener [11].
Figure 2C:
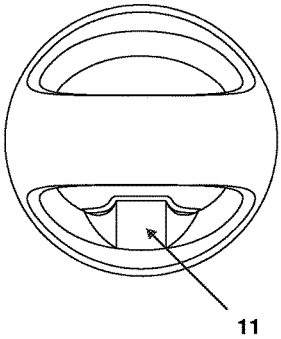
FIG. 2C is a top view of the cover showing the integrated bottle opener [11].
Figure 3:
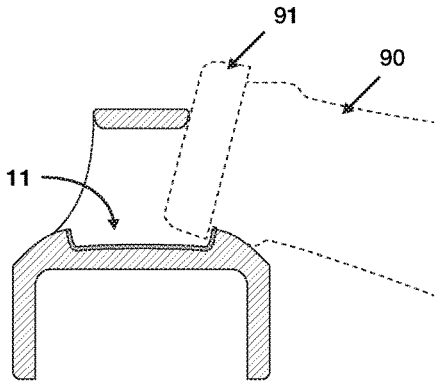
FIG. 3 is a side view of the cover, with a bottle [90] and bottle cap [91] engaging the integrated bottle opener [11].
Figure 4A:
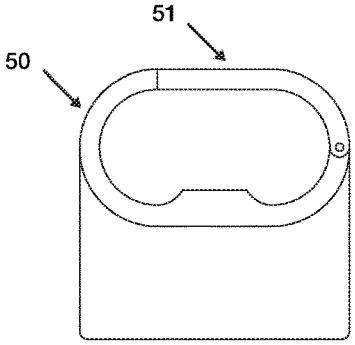
FIG. 4A is a side view of the cover with a spring-loaded gate [51] in the handle [50] in a closed position.
Figure 4B:
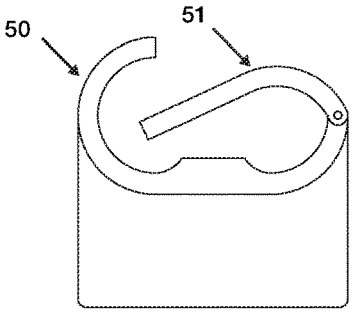
FIG. 4B is a front view of the cover with a spring-loaded gate [51] in an open position.
Figure 5A:
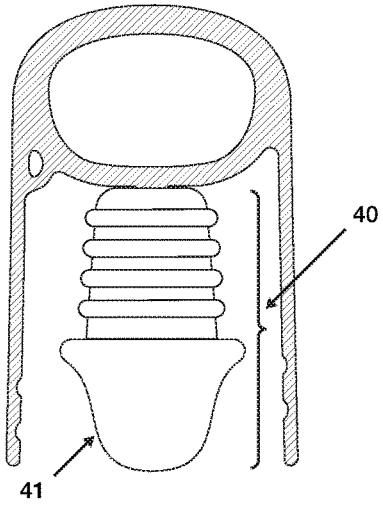
FIG. 5A is a side view of a stopper [40] with a thumb screw [41] that is stored within the cover.
Figure 5B:
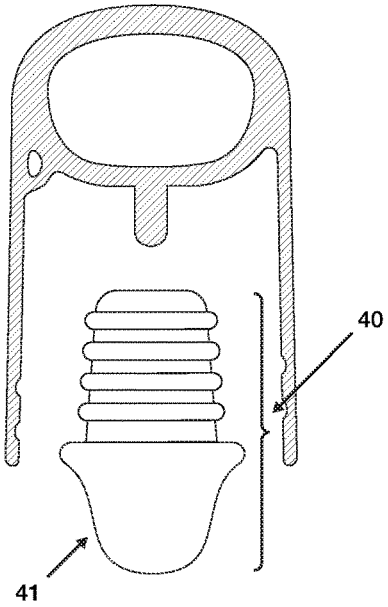
FIG. 5B is a front view of a stopper with a thumb screw in FIG. 4A.
Figure 6A:
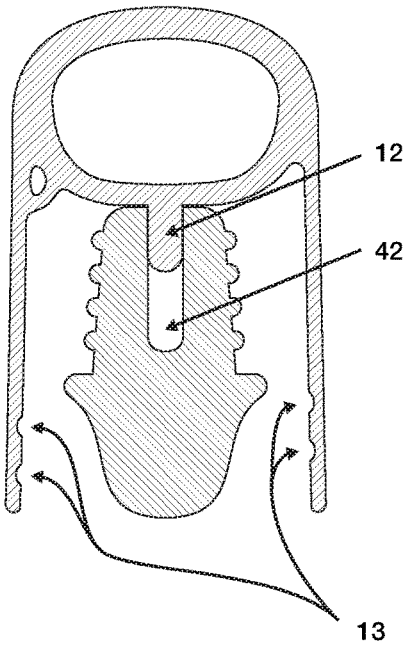
FIG. 6A is a cut-away view of the cover with a stopper with thumb screw attached to inner surface of the cover. Inward-facing threads [13] on the cover mate with external threads on the neck of the upper section of the body, shown in FIG. 8B. The downward-projecting post [12] is inserted into a hollow core/channel [42] in the stopper.
Figure 6B:
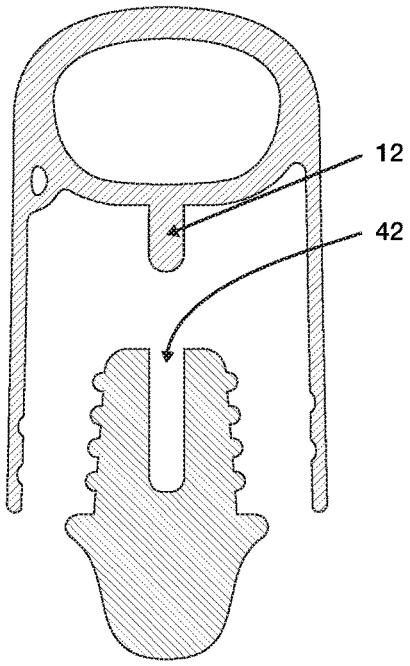
FIG. 6B is a cut-away view of the cover with a stopper with thumb screw removed (i.e., detached) from the downward-projecting post [12].
Figure 7A:
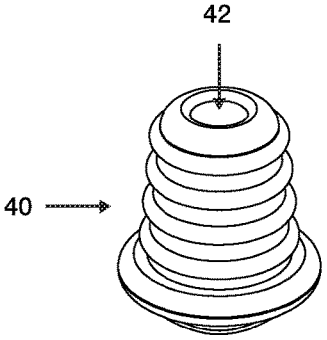
FIG. 7A is a front perspective view of the stopper [40] with hollow core/channel [42].
Figure 7B:
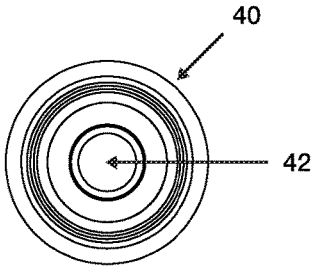
FIG. 7B is a top view of the stopper [40] with hollow core/channel [42].
Figure 8A:
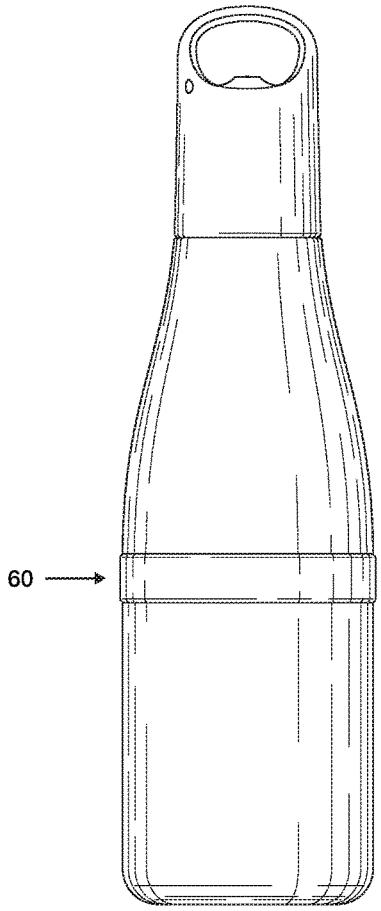
FIG. 8A shows an embodiment of the insulated beverage protector of the present invention in a closed position with an expansion ring [60] that mates with (preferably, threadably attaches to) the bottom of the upper section and the top of the base section.
Figure 8B:
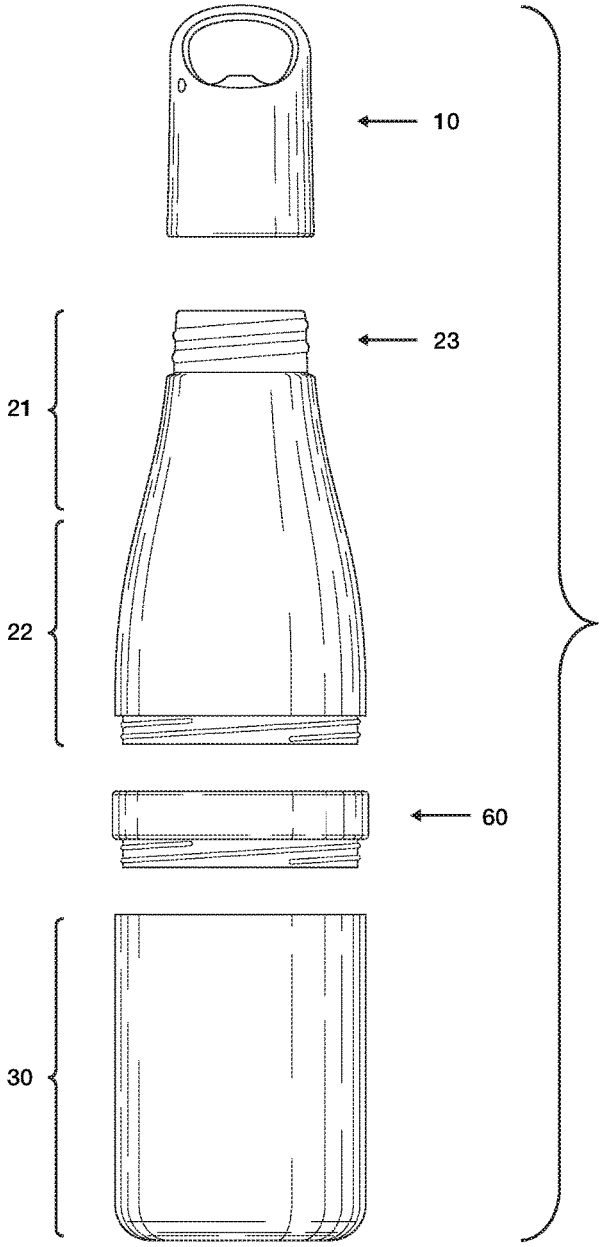
FIG. 8B is an exploded view of an embodiment of the insulated beverage protector of the present invention with the cover [10] separated from the upper section [21], the upper section separated from the expansion ring [60], and the expansion ring separated from the base section [30]. In this preferred embodiment, the neck on the upper section has external threads [23] which mate with internal threads on the bottom-most, inside edge of the cover (shown in FIG. 6A).

The present invention is directed to an insulated beverage protector for sealing and storing an opened bottle. By the term "bottle" is meant a narrow-necked container bottle having a top opening (a "mouth"), a tapered neck and a cylindrical base.

The insulated beverage protector of the present invention provides a snug fit for the bottle housed therein. By "snug fit" (and similar terms, e.g., "snugly fit") is meant that the outer wall of the bottle and the inner wall of the body of the insulated beverage protector are in contact with each other, preferably the contact is such that there are minimal gaps, still more preferably no gaps, between the outer wall of the bottle and the inner wall of the body of the insulated beverage.

The snug fit may be, and preferably is achieved by an elastomeric material within the body.

The elastomeric material may, in some embodiments, be inserted into the cavity formed by the inner wall of the body (e.g., as a sleeve).

The body may be, and preferably is, lined with an insulating material—for example, a neoprene sleeve.

The body may be single-walled, or double-walled.

In other embodiments, an elastomeric material may be affixed to the inside wall of the body. In this embodiment, the elastomeric material may be a single continuous piece wrapped in the form of a cylinder that hugs the internal circumference of the body, or a plurality of elastomeric pieces (e.g., strips).

When a bottle cap or closure is attached to the mouth, the bottle is "closed". When a bottle cap or closure is removed from the mouth, the bottle is "opened".

The insulated beverage protector is comprised of a body [20], a cover [10], and a stopper [40]. The body has at least two sections: (i) an upper section [21] that is tapered and configured to snugly surround the tapered neck of the bottle; and (ii) a base section [22] that is configured to snugly surround the cylindrical base of the bottle.

The base section securely attaches/couples to the upper section. A bottle is inserted in the insulated beverage protector by (i) uncoupling/detaching the upper section and the base section, (ii) inserting the top of the bottom through bottom of the upper section, and reattaching/coupling the base section to the upper section. Preferably, the top edge of the base section has inner threads, and the bottom edge of the upper section has external threads.

The body may contain one (or several) expansion ring(s) [60] that mate(s) with (preferably, threadably attaches to) the bottom of the upper section and the top of the base section.

Preferably, the outer wall of the body is constructed of metal or a metal alloy, more preferably stainless steel or aluminum.

The cover has a post [12] that projects downward from the topmost, inside surface.

A stopper [40] with a hollow core/channel [42] is removably attached to the post.

When a closed bottle is stored within the insulated beverage container, the stopper is kept in a "stored position" within the cover. The hollow core/channel within the stopper is mated with the downward-projecting post on the topmost, inside surface of the cover.

When a bottle stored in the insulated beverage container is opened (i.e., the bottle cap is removed from the bottle mouth), the bottle may be sealed by disengaging (i.e., removing) the stopper from the post, and inserting (preferably screwing) the stopper into the open bottle mouth, thereby sealing the bottle.

Preferably, the stopper has a thumb screw [41] or similar flat surface that can be easily grasped between the thumb and forefinger. More preferably, the stopper is tapered; and even more preferably, tapered with threads.

Importantly, the inner surface of the cover cannot form a seal with an open bottle mouth; the seal is formed by inserting the stopper into the bottle mouth.

In preferred embodiments, threads on the bottom of the inside surface of the cover mate (threadably attach/couple) with external threads on the neck of the upper section of the body.

In some embodiments, a bottle opener [11] is integrated on the outer top surface of the cover; in other embodiments, a bottle opener may be integrated on the outer bottom surface of the base section. By "bottle opener" is meant a lip that is placed under the edge of a bottle cap (i.e., metal cap that has been pleated or ruffled around the rim of a bottle mouth of a closed bottle) and enables removal of the bottle cap.

The integrated bottle opener may be constructed of metal.

Preferably, the cover has a handle [50].

In preferred embodiments, the handle in the cover has a spring-loaded gate [51]. The spring-loaded gate may be a D-shaped wire gate or D-shaped straight gate.

The invention claimed is:

1. An insulated beverage protector for sealing and storing an open bottle having a tapered neck and a cylindrical base comprised of (i) a body having at least two sections, that removably attach to each other
  a. an upper section that is tapered and configured to snugly surround the tapered neck of the bottle and
  b. a base section configured to snugly surround the cylindrical base of the bottle, and
(ii) a cover that removably attaches to the body, and
(iii) a stopper that removably attaches to an inside, top-most surface of the cover, wherein the stopper has a hollow channel that mates with a post that projects downward from the inside, top-most surface of the cover.

2. The insulated beverage protector of claim 1 further comprised of an integrated bottle cap opener.

3. The insulated beverage protector of claim 2 wherein the integrated bottle cap opener is on an outer surface of (a) the cover or (b) the base section.

4. The insulated beverage protector of claim 3 wherein the cover has a handle.

5. The insulated beverage protector of claim 4 wherein the handle has a spring-loaded gate.

6. The insulated beverage protector of claim 5 wherein an inner surface of the body is comprised of insulating material.

7. The insulated beverage protector of claim 6 wherein the insulating material is a neoprene sleeve.

8. The insulated beverage protector of claim 7 wherein a top-most outside edge of the upper section has external threads, and a bottom-most inside edge of the cover has internal threads.

9. The insulated beverage protector of claim 8 further comprising at least one extender ring that couples between a bottom of the upper section and a top of the base section.

10. The insulated beverage protector of claim 1 wherein the body is double-walled.

* * * * *